US008342156B2

(12) United States Patent
O'Shea et al.

(10) Patent No.: US 8,342,156 B2
(45) Date of Patent: Jan. 1, 2013

(54) BEARING ARRANGEMENT FOR A PUMP

(76) Inventors: Fergal Michael O'Shea, Washington, IL (US); Daniel R. Ibrahim, Metamora, IL (US); Joseph Shane Burkitt, Edwards, IL (US)

( * ) Notice: Subject to any disclaimer, the term of this patent is extended or adjusted under 35 U.S.C. 154(b) by 320 days.

(21) Appl. No.: 12/548,651

(22) Filed: Aug. 27, 2009

(65) Prior Publication Data

US 2011/0048384 A1 Mar. 3, 2011

(51) Int. Cl.
*F02M 37/06* (2006.01)
*F02M 37/04* (2006.01)

(52) U.S. Cl. ..... 123/508; 123/495

(58) Field of Classification Search ..... 123/445, 123/495, 508; 415/110, 111, 112; 384/583, 384/128, 126; 418/191
See application file for complete search history.

(56) References Cited

U.S. PATENT DOCUMENTS

| | | | | |
|---|---|---|---|---|
| 3,083,645 | A * | 4/1963 | Donner et al. | 418/74 |
| 3,682,567 | A * | 8/1972 | D'Amato | 418/173 |
| 3,973,880 | A * | 8/1976 | Swedberg | 418/61.3 |
| 4,704,096 | A * | 11/1987 | Marek | 464/156 |
| 5,116,145 | A | 5/1992 | Jan de Vries | |
| RE35,404 | E | 12/1996 | Brown | |
| 6,095,766 | A | 8/2000 | Brown | |
| 6,929,449 | B2 | 8/2005 | Zagone et al. | |
| 7,018,296 | B2 | 3/2006 | Rauschenbach et al. | |
| 2004/0213662 | A1 | 10/2004 | Albright et al. | |
| 2004/0213663 | A1 | 10/2004 | Duerr et al. | |

* cited by examiner

*Primary Examiner* — Mahmoud Gimie
(74) *Attorney, Agent, or Firm* — Miller, Matthias & Hull

(57) ABSTRACT

A fluid pump is disclosed. The fluid pump may comprise a housing, a tapered bearing, a drive shaft, a first fluid chamber, and a second fluid chamber. The housing defines a bore. The tapered bearing is received within the bore of the housing. The drive shaft is received within the tapered bearing. The first fluid chamber is defined between the housing and the drive shaft on a first side of the tapered bearing. The second fluid chamber is defined between the housing and the drive shaft on a second side of the tapered bearing. The second fluid chamber is separated from the first fluid chamber by the tapered bearing. The housing includes a fluid passage fluidly coupling the first fluid chamber and the second fluid chamber.

17 Claims, 3 Drawing Sheets

BEARING ARRANGEMENT FOR A PUMP

TECHNICAL FIELD

The present disclosure is directed to a pump and, more particularly, to a bearing arrangement for a pump.

BACKGROUND

Fluid pumps are available in a number of different configurations and are used for a multitude of different applications. In many of these applications, the internal components of the pump require some sort of lubrication. One of the most common ways to provide this lubrication is to expose the internal components of the pump to a lubricant, such as oil. However, because the fluid that is being pumped is often a different fluid than the lubricant, care must be taken to ensure that the pumped fluid and the lubricant do not mix.

Such contamination can be avoided in different ways, depending the on the configuration of the pump being used. One relatively common pump configuration utilizes a primary drive shaft that includes a driven member (e.g., a member, such as a gear, that engages the power source that provides the power to operate the pump) on one end and a working member (e.g., an element or elements, such as an impeller or a set of gears, that cooperate together to provide a pumping action) on the other end. The drive shaft is generally supported within the pump housing by at least two bearings, one provided near each end of the drive shaft. The end of the drive shaft with the driven member is often exposed to a lubricant (e.g., oil) while the end with the working member is exposed to the fluid that is being pumped. To avoid contamination of the pumped fluid and oil with one another, at least one seal that keeps the lubricant and pumped fluid separate is generally provided at some point along the drive shaft. The seal is normally provided on the side of the bearing that is opposite the driven member to ensure that the bearing near the driven member of the drive shaft is lubricated.

For pumps with such a configuration, the lubricant (e.g., oil) may become substantially trapped between the bearing and the seal. Friction with the rotating drive shaft and seal may cause this trapped volume of oil to overheat. When the oil overheats, carbon particles may be generated within the oil that, over time, may lead to seal or shaft wear and eventually leakage of oil between the shaft and the seal.

The disclosed pump is directed to overcoming one or more of the problems set forth above or other problems.

SUMMARY

According to one exemplary embodiment, a fluid pump comprises a housing, a tapered bearing, a drive shaft, a first fluid chamber, and a second fluid chamber. The housing defines a bore. The tapered bearing is received within the bore of the housing. The drive shaft is received within the tapered bearing. The first fluid chamber is defined between the housing and the drive shaft on a first side of the tapered bearing. The second fluid chamber is defined between the housing and the drive shaft on a second side of the tapered bearing. The second fluid chamber is separated from the first fluid chamber by the tapered bearing. The housing includes a fluid passage fluidly coupling the first fluid chamber and the second fluid chamber.

According to another exemplary embodiment, a method of providing fluid circulation between a first chamber and a second chamber, where each of the first chamber and the second chamber are defined between a housing and a shaft rotatably received within the housing, comprises the step of supporting the shaft within the housing with a tapered bearing located between the first chamber and the second chamber. The method also comprises the step of providing a fluid passage between the first chamber and the second chamber. The method also comprises the steps of circulating fluid from the first chamber to the second chamber through the tapered bearing during rotation of the shaft and circulating fluid from the second chamber to the first chamber through the fluid passage during rotation of the shaft.

According to another exemplary embodiment, an engine comprises at least one combustion chamber and a fuel system. The fuel system is for transferring fuel to the at least one combustion chamber and includes a fuel transfer pump. The fuel transfer pump includes a housing, a tapered bearing, a second bearing, a drive shaft, a first seal, a first fluid chamber, and a second fluid chamber. The housing defines a bore. The tapered bearing and a second bearing are received within the bore of the housing. The drive shaft is rotatably received within the tapered bearing and the second bearing. The first seal is located between the tapered bearing and the second bearing and forms a seal between the drive shaft and the bore of the housing. The first fluid chamber is defined at least in part by the tapered bearing and the first seal. The second fluid chamber is located on the opposite side of the tapered bearing as the first fluid chamber and is separated from the first fluid chamber by the tapered bearing. The housing includes a fluid passage fluidly coupling the first fluid chamber and the second fluid chamber.

Although the drawings depict exemplary embodiments or features of the present disclosure, the drawings are not necessarily to scale, and certain features may be exaggerated in order to provide better illustration or explanation. The exemplifications set out herein illustrate exemplary embodiments or features, and such exemplifications are not to be construed as limiting the inventive scope in any manner.

DETAILED DESCRIPTION

Reference will now be made in detail to specific embodiments or features, examples of which are illustrated in the accompanying drawings. Generally, the same or corresponding reference numbers will be used throughout the drawings to refer to the same or corresponding parts.

Figure 1:
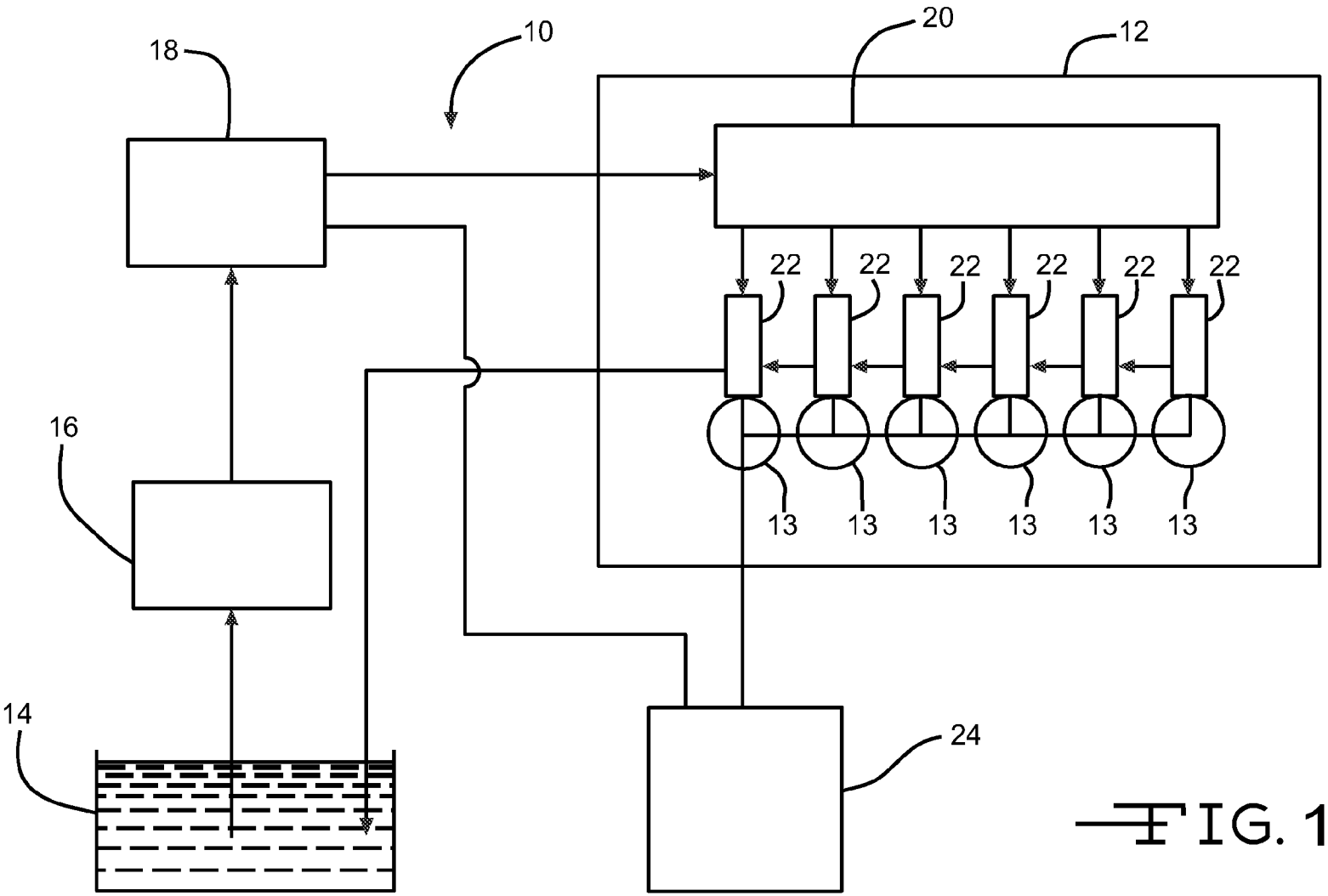
FIG. 1 is a schematic illustration of a fuel system according to one exemplary embodiment.

Referring generally to FIG. 1, a fuel system 10 is shown according to one exemplary embodiment. Fuel system 10 is a system of components that cooperate to deliver fuel (e.g., diesel, gasoline, heavy fuel, etc.) from a location where fuel is stored to the combustion chamber(s) 13 of an engine 12 where it will combust and where the energy released by the combustion process will be captured by engine 12 and used to generate a mechanical source of power. Although depicted in FIG. 1 as a fuel system for a diesel engine, fuel system 10 may be the fuel system of any type of engine (e.g., an internal combustion engine such as a gaseous fuel or gasoline engine, a turbine, etc.). According to one exemplary embodiment, fuel system 10 includes a tank 14, a transfer pump 16, a high-pressure pump 18, a common rail 20, fuel injectors 22, and an electronic control module (ECM) 24.

Tank 14 is a storage container that stores the fuel that fuel system 10 will deliver. Transfer pump 16 pumps fuel from tank 14 and delivers it at a generally low pressure to high-pressure pump 18. High-pressure pump 18, in turn, pressurizes the fuel to a high pressure and delivers the fuel to common rail 20. Common rail 20, which is intended to be maintained at the high pressure generated by high-pressure pump 18, serves as the source of high-pressure fuel for each of fuel injectors 22. Fuel injectors 22 are located within engine 12 in a position that enables fuel injectors 22 to inject high-pressure fuel into combustion chambers 13 of engine 12 (or into pre-chambers or ports upstream of combustion chambers 13 in some cases) and generally serve as metering devices that control when fuel is injected into the combustion chamber, how much fuel is injected, and the manner in which the fuel is injected (e.g., the angle of the injected fuel, the spray pattern, etc.). Each fuel injector 22 is continually fed fuel from common rail 20 such that any fuel injected by a fuel injector 22 is quickly replaced by additional fuel supplied by common rail 20. ECM 24 is a control module that receives multiple input signals from sensors associated with various systems of engine 12 (including fuel system 10) and indicative of the operating conditions of those various systems (e.g., common rail fuel pressure, fuel temperature, throttle position, engine speed, etc.). ECM 24 uses those inputs to control, among other engine components, the operation of high-pressure pump 18 and each of fuel injectors 22. The general purpose of fuel system 10 is to ensure that the fuel is continually being fed to engine 12 in the appropriate amounts, at the right times, and in the right manner to support the operation of engine 12.

Figure 2:
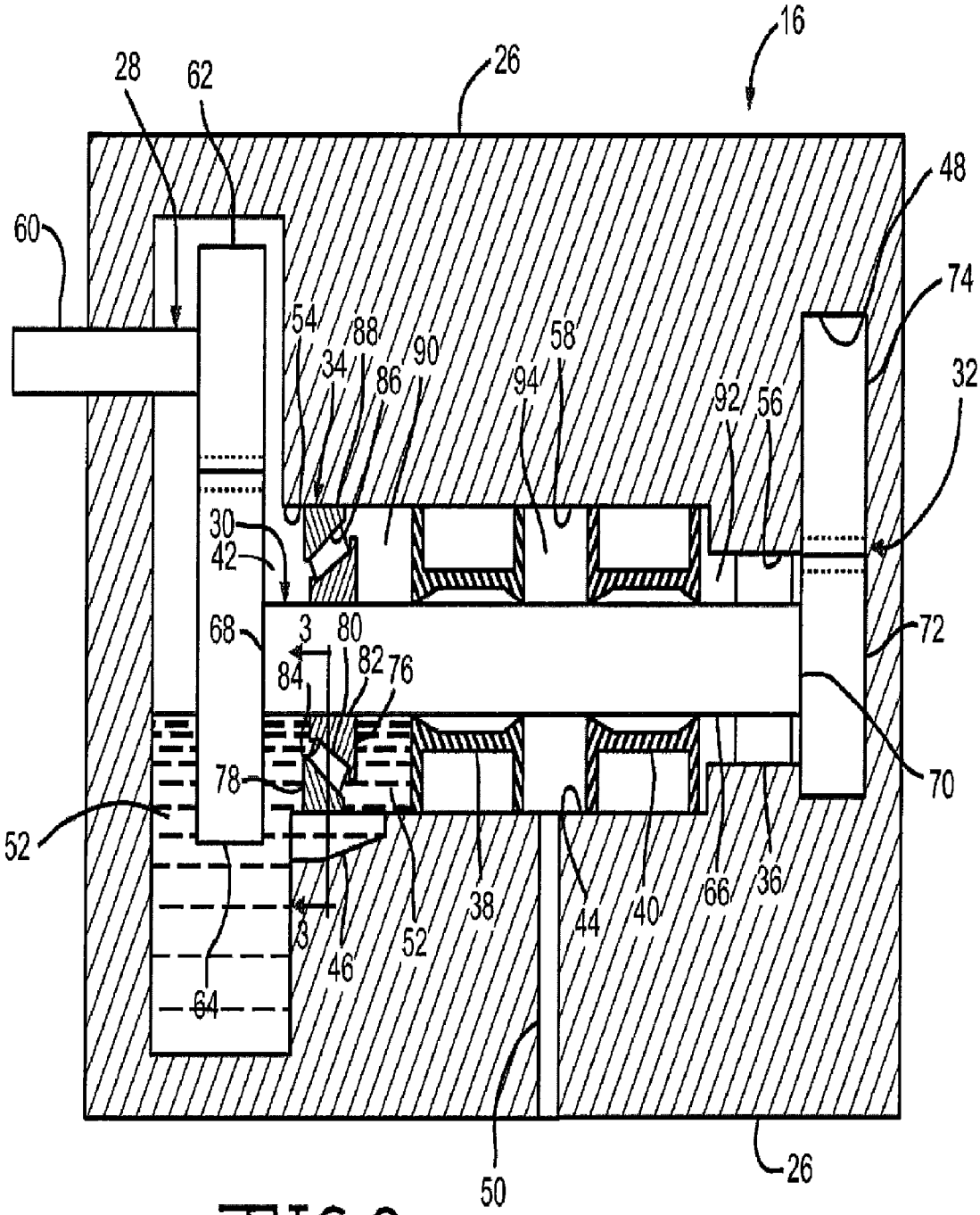
FIG. 2 is a diagrammatic illustration of a pump according to one exemplary embodiment.

Referring now to FIG. 2, fuel transfer pump 16 is a device or component that draws fuel from tank 14 and transfers it under pressure to high-pressure pump 18. According to one exemplary embodiment, fuel transfer pump 16 includes a housing 26, an input assembly 28, a drive shaft assembly 30, a pump apparatus 32, tapered bearing 34, bearing 36, a oil seal 38, and a fuel seal 40.

Housing 26 is a generally rigid member that provides the structure that supports the other components of pump 16 and that cooperates with other components to enable the pumping action of pump 16. According to one exemplary embodiment, housing 26 includes an input chamber 42, a bore 44, a fluid passage 46, a pump chamber 48, an inlet, an outlet, and a drain passage 50. Input chamber 42 is a cavity within housing 26 that is configured to receive input assembly 28 and a portion of drive shaft assembly 30. Input chamber 42 also serves as a reservoir for lubricant (e.g., oil) that provides the lubrication for input assembly 28 and drive shaft assembly 30. Bore 44 is a generally cylindrical opening within housing 26 that extends between input chamber 42 and pump chamber 48 and that is configured to receive a portion of drive shaft assembly 30. Bore 44 includes an end 54 near input chamber 42, an end 56 near pump chamber 48, and a central region 58 that extends between ends 54 and 56. Bore 44 may include one or more steps or transitions in its diameter (such as in the region of end 56) to facilitate, among other things, the use of different bearing or seal configurations at different points along the axis of bore 44.

Figure 3:
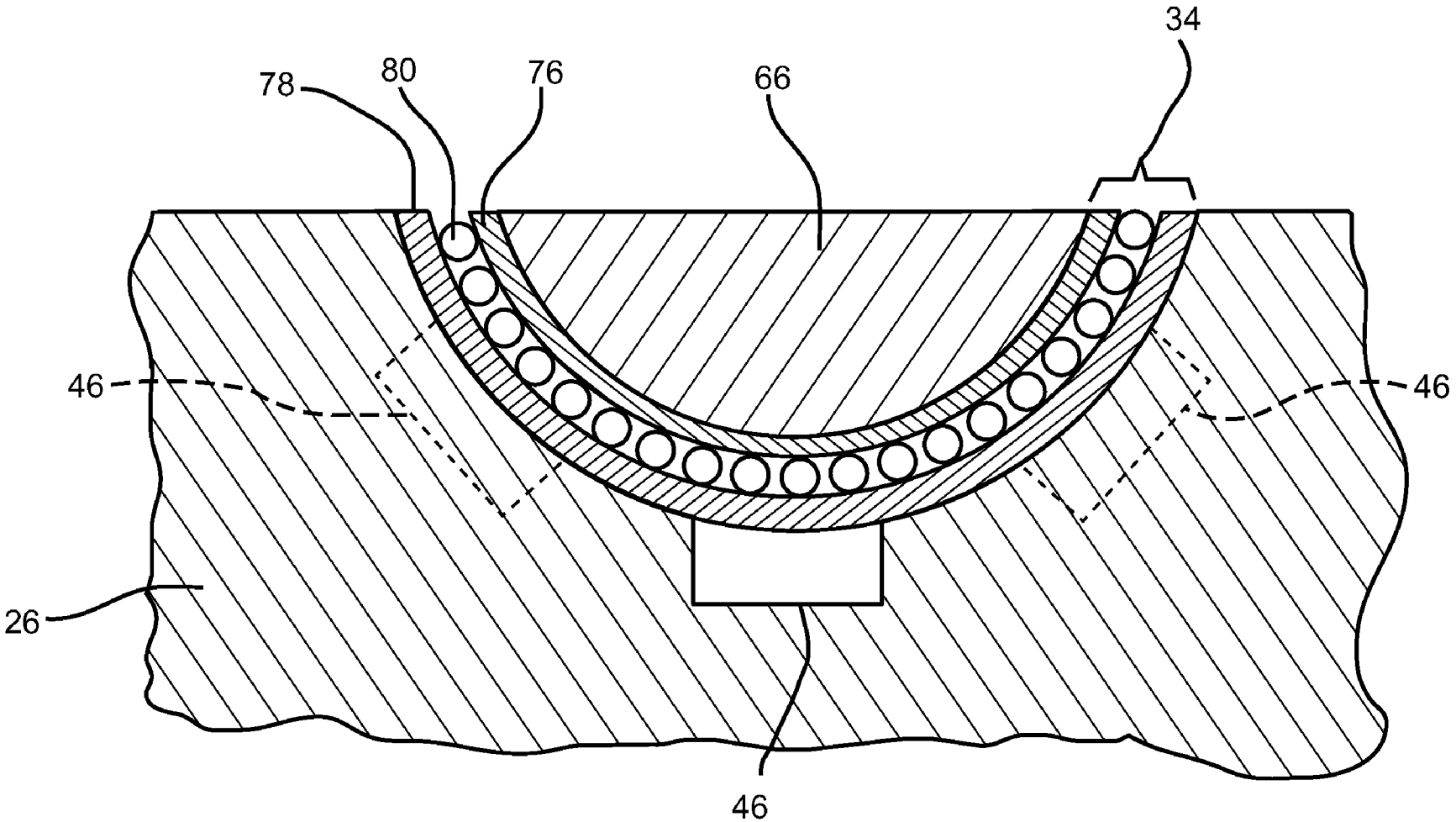
FIG. 3 is a partial cross-sectional illustration of the pump of FIG. 2 taken along line 3-3.

Referring now to FIGS. 2 and 3, fluid passage 46 is provided near end 54 of bore 44 and serves as a duct or conduit that allows fluid to pass between input chamber 42 and bore 44 without having to pass through tapered bearing 34. According to one exemplary embodiment, fluid passage 46 is a groove, notch, or channel in the wall of bore 44 and extends axially into bore 44 beginning from input chamber 42 and extending to a position along bore 44 beyond the location of tapered bearing 34 so as to form a fluid path between fluid chambers on each side of tapered bearing 34. According to various exemplary and alternative embodiments, the fluid passage may take any one of a variety of different shapes, sizes and configurations. For example, the cross-sectional shape of the fluid passage, taken in a plane perpendicular to the axis of bore 44, may be rectangular, semi-circular, arc-shaped, v-shaped, barrel-shaped, or any other suitable shape. Similarly, the cross-sectional shape of the fluid passage, taken in a plane that includes the axis of bore 44, may be rectangular, triangular, semi-circular, arc-shaped, trapezoid-shaped, generally flat with rounded or radiused ends, or any other suitable shape. According to other various exemplary and alternative embodiments, the fluid passage may be any channel, duct, conduit, passage, or groove that fluidly couples a chamber formed on one side of tapered bearing 34 with a chamber formed on the other side of tapered bearing 34. For example, the fluid passage could be a hole within the housing that extends from one portion of bore 44 to another portion of bore 44 (at the opposite side of tapered bearing 34), or that extends from a portion of bore 44 into input chamber 42. Depending on the orientation of pump 16 when in use, housing 26 may include one or more fluid passages 46, each of which may be provided at different locations around the circumference of bore 44. According to one exemplary embodiment, at least one fluid passage 46 is provided at a location around the circumference of bore 44 at which the lubricant will pool or collect, or in most cases, at the lowest elevational point of bore 44 (which will depend on the orientation of pump 16 when it is in use) to allow any pooling lubricant to flow through fluid passage 46.

Pump chamber 48 is a cavity within housing 26 that is configured to receive and cooperate with pump apparatus 32 and a portion of drive shaft assembly 30 to draw a pumped fluid from a source (e.g, tank 14) and pump the pumped fluid to a desired location (e.g, high pressure pump 18). Depending on the configuration of pump apparatus 32 (e.g., cooperating gears, an impeller, vane assembly, etc.), pump chamber 48 may take one of a variety of different shapes and sizes. Pump chamber 48 includes an inlet, from which the pumped fluid enters pump chamber 48, and an outlet, from which the pumped fluid exits pump chamber 48. Drain passage 50 is a duct or conduit provided within housing 26 that serves to fluidly couple a portion of bore 44 to a drain (or to the atmosphere) such that fluid within bore 44 in the area of drain passage 50 may be drained from bore 44.

According to various alternative and exemplary embodiments, housing 26 may be integrally formed as a single unitary body or as two or more separate members coupled together. Housing 26 may also be formed from any one or more of a variety of different materials, depending at least in part on the environment in which it will be used and on the fluids into which it will come into contact. For example, the housing may be made from various metals, polymers, elastomers, ceramics, composites, and/or other suitable materials. According to other various alternative and exemplary embodiments, the housing may take one of a multitude of different forms or shapes, or be provided in a variety of different sizes, that make it suitable for incorporation into a particular fuel system or other fluid system or suitable for placement within a certain physical space. For example, the housing may include one or more different interfaces or engagements points (e.g., threaded interfaces, etc.) that allow it to be fluidly coupled to one or more other fluid system components. The housing may also include one or more brackets, flanges, projections, recesses, grooves, or other structures that facilitate the physical coupling of the housing to one or more other structures, such as an engine block, high-pressure pump 18, a frame member, or other structures.

Input assembly 28 is an assembly of components that serve to transfer power or torque provided by an external source, such as the crankshaft of engine 12 or other source, such as an internal or external electric motor, to drive shaft assembly 30 and then ultimately to pump apparatus 32 (via drive shaft assembly 30). Depending on the source of power for pump 16, the configuration of pump 16, where and how pump 16 is mounted or coupled within a particular system, and other factors, input assembly 28 may take any one of a variety of different configurations. According to one exemplary embodiment, input assembly includes an input shaft 60 and a drive gear 62. Input shaft 60 is configured to be coupled to a power source and to transfer torque from the power source to drive gear 62. To facilitate the coupling of input shaft 60 with a power source, it may be coupled to a gear, it may be formed so as to have gear teeth formed in the end of the shaft, it may be keyed or splined, or it may be configured in any one of a variety of different ways that facilitate the transfer of torque from the power source to input shaft 60. Drive gear 62 is coupled to input shaft 60 and serves to transfer torque from input shaft 60 to drive shaft assembly 30. According to various exemplary and alternative embodiments, input assembly may take one or more of a variety of different configurations. In other embodiments, drive shaft assembly 30 may be coupled directly to a power source, in which case input assembly 28 may not be provided.

Drive shaft assembly 30 generally serves to transfer torque provided by input assembly 28 to pump apparatus 32. Depending on the configuration of pump 16, drive shaft assembly 30 may take one of a variety of different configurations and may include one or more of a variety of different components to facilitate the transfer of torque and the mounting of drive shaft assembly 30 within housing 26. According to one exemplary embodiment, drive shaft assembly 30 includes a driven gear 64 and a shaft 66. Driven gear 64 is configured to mate with drive gear 62 of input assembly 28 in order facilitate the transfer of torque from drive gear 62 to driven gear 64. According to various exemplary and alternative embodiments, both driven gear 64 and drive gear 62 may take one of a variety of different mating configurations and forms. For example, driven gear 64 and drive gear 62 may be selected from a variety of different gearing arrangements, such as helical gears, spur gears, bevel gears, face gears, worm gears, bevel gears, spiral gears, or other types of gear arrangements. The driven gear and drive gear could also be replaced with pulleys or sprockets or other members and may engage one another through belts, chains, clutches, couplers, etc. Shaft 66 is an elongated, generally cylindrical bar or pin that serves to transfer torque from driven gear 64 to pump apparatus 32. Shaft 66 includes an end 68 that is coupled to driven gear 64 and an end 70 that is coupled to pump apparatus 32.

Pump apparatus 32 (e.g., working member) is an element or assembly of components or elements that cooperate together and with pump chamber 48 of housing 26 to draw a pumped fluid into the inlet of housing 26 and force it out of the outlet of housing 26. According to one exemplary embodiment, pump apparatus 32 includes two cooperating gears, a drive gear 72 and a driven gear 74. Drive gear 72 is coupled to end 70 of shaft 66 and rotates along with shaft 66. Driven gear 74 is rotatably coupled to housing 26 and is driven by drive gear 72. Together with pump chamber 48 of housing 26, drive gear 72 and driven gear 74 form a gear pump that draws the pumped fluid into the inlet of housing 26 and forces the pumped fluid out of the outlet of housing 26. According to various other exemplary and alternative embodiments, the pump apparatus may be any other type of element or assembly that operates to draw fluid from one source and transfer it to another location. For example, the pump apparatus may be an impeller, a vane assembly (such as that used vane type pumps), or other type or style of pump apparatus.

Tapered bearing 34 is a friction reducing member or device that is coupled between the inner surface of bore 44 of housing 26 and shaft 66 of drive shaft assembly 30, proximate end 68 of shaft 66, to facilitate the coupling and rotation of drive shaft assembly 30 within housing 26. According to one exemplary embodiment, tapered bearing 34 includes an inner race 76, an outer race 78, and rolling elements 80 positioned between inner race 76 and outer race 78. Inner race 76 includes an inner surface 82 that fits over shaft 66 and a tapered outer surface 84 that engages roller elements 80. Tapered outer surface 84 is tapered such that its diameter increases in a direction toward end 70 of shaft 66. Outer race 78 includes a tapered inner surface 86 that engages rolling elements 80 and an outer surface 88 that fits within an inner surface of bore 44. Tapered inner surface 86 is also tapered such that its diameter increases in a direction toward end 70 of shaft 66. Multiple rolling elements 80 are provided between inner race 76 and outer race 78 and generally serve to allow the rotation of inner race 76 relative to outer race 76 with relatively little friction. According to one exemplary embodiment, rolling elements 80 are generally cylindrical rollers and tapered bearing 34 is a tapered roller bearing. According to other exemplary and alternative embodiments, the rolling element may take other shapes (e.g., balls, barrels, needles, etc.) and the bearing may be a different type of bearing (e.g., ball bearing, needle bearing, etc.). According to another alternative embodiment, the direction of tapered bearing 34 may be reversed, such that tapered outer surface 84 of inner race 76 and tapered inner surface 86 of outer race 78 are tapered such that their diameter decreases in a direction toward end 70 of shaft 66. According to still other exemplary and alternative embodiments, the outer surface of the outer race of the tapered bearing and/or the inner surface of the inner race of the tapered bearing may include one or more fluid passages similar to those exemplary and alternative embodiments described above in connection with fluid passage 46. Such fluid passages may be provided as an alternative to fluid passages 46 in housing 26 or in addition to fluid passages 46.

Due to its tapered configuration, tapered bearing 34 may provide a pumping action when exposed to a fluid. As shaft 66 rotates, inner race 76 will rotate along with shaft 66. The rotation of inner race 76 will cause lubricant to rotate along with it. As the lubricant rotates with inner race 76, centrifugal force will force the lubricant radially outwardly onto tapered inner surface 86 of outer race 78. The lubricant will then flow axially along tapered inner surface 86 to progressively larger diameter regions of tapered inner surface 86 until the lubricant will eventually exit the side of tapered bearing 34 where tapered inner surface 86 of outer race 78 has the largest diameter. In this way, fluid on the side of tapered bearing 34 where tapered inner surface 86 of outer race has the smallest diameter is "pumped" or forced to the opposite side of tapered bearing 34, the side of tapered bearing 34 where tapered inner surface 86 of outer race 78 has the largest diameter.

Bearing 36 is a friction reducing member or device that is coupled between the inner surface of bore 44 of housing 26 and shaft 66 of drive shaft assembly 30, proximate end 70 of shaft 66, to facilitate the coupling and rotation of drive shaft assembly 30 within housing 26. According to one exemplary embodiment, bearing 36 is a bushing formed from a relatively short and thin tube that is constructed from a low-friction, wear resistant material. According to other alternative and exemplary embodiments, bearing 36 may be any one of a variety of different types of bearings or bushings, including a ball bearing, a roller bearing, a tapered roller bearing, a plain bearing, etc.

Oil seal 38 is an element, member, or assembly that extends between the inner surface of bore 44 and shaft 66 and that serves to create a seal that prevents, or substantially prevents, any fluid from passing by it. According to one exemplary embodiment, oil seal 38 is provided on the opposite side of tapered bearing 34 as input chamber 42 so as to create a lubricant chamber 90 formed by tapered bearing 34, oil seal 38, shaft 66, and the inner surface of bore 44. Oil seal 38 may take any one of a variety of different configurations. For example, oil seal 38 may be one of the different varieties of radial shaft seals. Oil seal 38 may also be made from one or more of a variety of different materials, such as metal, polymers, elastomers, rubber, composites, etc.

Fuel seal 40 is an element, member, or assembly that extends between the inner surface of bore 44 and shaft 66 and that serves to create a seal that prevents, or substantially prevents, any fluid from passing by it. According to one exemplary embodiment, fuel seal 40 is provided on the opposite side of bearing 36 as pump chamber 48 so as to create a fuel chamber 92 formed by bearing 36, fuel seal 40, shaft 66, and the inner surface of bore 44. Fuel seal 40 and oil seal 38 may be spaced apart from one another to form a leak chamber 94 that would contain any fuel that leaked past fuel seal 40 and any oil that leaked past oil seal 38. Leak chamber 94 cooperates with drain passage 50 of housing 26 to allow any leakage to be removed from leak chamber 94. Thus, drain passage 50 may serve as a tell-tale or weep hole such that any leakage from drain passage 50 can alert an operator of a potential failure (e.g., with the seals or other pump components) within pump 16. Fuel seal 40 may take any one of a variety of different configurations. For example, the fuel seal may be one of the different varieties of radial shaft seals. Fuel seal 40 may also be made from one or more of a variety of different materials, such as metal, polymers, elastomers, rubber, composites, etc. Fuel seal 40 may be the same seal as oil seal 38, or they may be different.

According to various alternative and exemplary embodiments, the various elements of pump 16 may be arranged into a multitude of different combinations and configurations. For example, more than two bearings may be utilized, both bearings may be tapered roller bearings, the bearings and seals may be provided in different locations along the length of shaft 66, one seal may be used instead of two seals, the size and relative proportions of the components may be different, and a multitude of other changes may be made to pump 16 without departing from the intended scope of the present disclosure.

Although illustrated and generally described in conjunction with an external gear pump used as a fuel transfer pump, the bearing arrangement including tapered bearing 34 and the cooperating fluid passage 46 may be used with any type of pump (e.g., vane pump, centrifugal pump, etc.), as part of any of a variety of different types of fluid systems (hydraulic, coolant, lubrication, hydraulic actuation systems, etc.), and with any of a variety of different fluids. The disclosed bearing arrangement may also be used in connection with other devices that include a rotating shaft and a tapered bearing that separates two different chambers, between which the flow of fluid is desirable.

INDUSTRIAL APPLICABILITY

Pumps are utilized in a variety of different applications and are available in a variety of different configurations. One common pump configuration utilizes a main drive shaft that transfers torque from a power source to a pumping device or object, such as mating gears or an impeller. Bearings are often used to retain the drive shaft within a housing of the pump while providing relatively little resistance to the rotation of the drive shaft. In many cases, at least some of the bearings and other components of a pump will require lubrication, and the lubricant used for lubrication will be different than the fluid that the pump is being used to pump. In these cases, seals are often used to keep the lubricant and the pumped fluid separate. However, when both seals and bearings are used, a situation could arise where a chamber is formed between one of the bearings and one of the seals that eventually fills up with fluid (e.g., the lubricant or the pumped fluid). It is then possible for that fluid to become essentially trapped within the chamber. When the pump is used, friction between the fluid and the rotating drive shaft may cause this relatively small volume of trapped fluid to overheat. Depending on the characteristics of the trapped fluid, overheating may lead to the formation of carbon particles within the fluid. Over time, these carbon particles create wear on the drive shaft, the bearing, and/or the seal, which may eventually lead to the premature failure of the pump. The pump and bearing arrangement described in this disclosure are intended to reduce the likelihood of such a pump failure by providing a simple means for circulating fluid through what was formerly a substantially trapped volume.

Referring now to FIGS. 2 and 3, the operation of pump 16 will now be described. Input assembly 28 is configured to be coupled to an external power source, such as the crankshaft of engine 12, which rotates input assembly 28. Input assembly 28 is coupled to drive shaft assembly 30 such that rotation of input assembly 28 causes drive shaft assembly 30 to rotate. Drive shaft assembly 30 is coupled to pump apparatus 32 such that rotation of drive shaft assembly 30 causes drive gear 72 and driven gear 74 to rotate. The rotation of drive gear 72 and driven gear 74 (which together with pump chamber 48 of housing 26 form the core of an external gear pump) draws fuel from tank 14 into the inlet of housing 26 and pumps it out of the outlet of housing 26 to high pressure pump 18.

To keep the interface between input assembly 28 and drive shaft assembly 30 sufficiently lubricated, input chamber 42 of housing 26 may be at least partially filled with lubricant 52 (e.g., oil). As described above, tapered bearing 34 generates a pumping effect that "pumps" lubricant 52 from input chamber 42 into lubricant chamber 90. At the same time lubricant 52 is being pumped into lubricant chamber 90 from input chamber 42, lubricant 52 is being forced out of lubricant chamber 90 and back into input chamber 42 through fluid passage 46. Thus, the combination of tapered bearing 34 and fluid passage 46 creates a lubricant flow path (indicated by the arrows in FIG. 2) that allows lubricant 52 to circulate through lubricant chamber 90 rather than become trapped within lubricant chamber 90. The circulation of lubricant 52 between lubricant chamber 90 and input chamber 42 helps to keep lubricant 52 from overheating, which in turn reduces the formation of carbon particles within lubricant 52, which then reduces the likelihood of any wear or damage caused by the carbon particles.

It is important to note that the construction and arrangement of the elements of the fuel transfer pump and the bearing arrangement as shown in the exemplary and other alternative embodiments is illustrative only. Although only a few embodiments of the pump and bearing arrangement have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, orientations, component locations, etc.) without materially departing from the novel teachings and advantages of the subject matter recited. For example, elements shown as integrally formed may be constructed of multiple parts or elements shown as multiple parts may be integrally formed, the operation of the interfaces (e.g., the drive and driven gears, input shafts, etc.) may be reversed or otherwise varied, and/or the length, width, diameter, or other dimensions of the structures and/or members or connectors or other elements of the system may be varied. It should be noted that the elements and/or assemblies of the pump and the bearing arrangement may be constructed from any of a wide variety of materials that provide sufficient strength or durability, and in any of a wide variety of combinations. It should also be noted that the pump and/or bearing arrangement may be used in association with any of a wide variety of fluid systems or fluid subsystems in any of a wide variety of applications. Accordingly, all such modifications are intended to be included within the scope of the present disclosure. Other substitutions, modifications, changes and omissions may be made in the design, operating conditions and arrangement of the exemplary and other alternative embodiments without departing from the spirit of the present disclosure.

What is claimed is:

1. A fluid pump comprising:

a housing defining a bore;

a tapered bearing received within the bore of the housing;

a first seal received within the bore of the housing;

a drive shaft received within the tapered bearing;

a first fluid chamber defined between the housing and the drive shaft on a first side of the tapered bearing; and a second fluid chamber defined between the tapered bearing, the housing, the drive shaft and the first seal on a second side of the tapered bearing, the second fluid chamber being separated from the first fluid chamber by the tapered bearing;

wherein the housing includes a fluid passage fluidly coupling the first fluid chamber and the second fluid chamber.

2. The fluid pump of claim 1, further comprising a second seal forming a seal between the bore of the housing and the drive shaft, a third fluid chamber being at least partially defined by the first seal and the second seal.

3. The fluid pump of claim 2, further comprising a second bearing received within the bore of the housing and receiving the drive shaft, a fourth fluid chamber being at least partially defined by the second seal and the second bearing.

4. The fluid pump of claim 3, further comprising a fifth fluid chamber being at least partially defined by the second bearing and a portion of the housing, the first fluid chamber being located on the opposite side of the second bearing as the fifth fluid chamber.

5. The fluid pump of claim 4, wherein the drive shaft is coupled to a driven member located within the first fluid chamber and to a working member located within the fifth fluid chamber.

6. The fluid pump of claim 4, wherein the first fluid chamber and the second fluid chamber are exposed to a first fluid and wherein the fourth fluid chamber and the fifth fluid chamber are exposed to a second fluid different than the first fluid.

7. The fluid pump of claim 6, wherein the housing includes a drain passage fluidly coupled to the third fluid chamber.

8. The fluid pump of claim 6, wherein the first fluid is oil and the second fluid is diesel fuel.

9. The fluid pump of claim 1, wherein the fluid passage in the housing is a groove extending into a portion of the bore surrounding the tapered bearing and wherein the groove extends from the first side of the tapered bearing to the second side of the tapered bearing.

10. A method of providing fluid circulation between a first chamber and a second chamber, each of the first chamber and the second chamber being defined between a housing and a shaft rotatably received within the housing, the method comprising the steps of:

supporting the shaft within the housing with a tapered bearing located between the first chamber and the second chamber, the second chamber being defined by the tapered bearing, the drive shaft, the housing and a first seal disposed opposite the tapered bearing from the first chamber;

providing a fluid passage between the first chamber and the second chamber;

circulating fluid from the first chamber to the second chamber through the tapered bearing during rotation of the shaft; and circulating the fluid from the second chamber to the first chamber through the fluid passage during rotation of the shaft.

11. The method of claim 10, further comprising the step of supporting the shaft within the housing with a second bearing, the second chamber being located between the tapered bearing and the second bearing.

12. An engine comprising:

at least one combustion chamber;

a fuel system for transferring fuel to the at least one combustion chamber, the fuel system including a fuel transfer pump, the fuel transfer pump including:

a housing defining a bore;

a tapered bearing and a second bearing received within the bore of the housing;

a drive shaft rotatably received within the tapered bearing and the second bearing;

a first seal located between the tapered bearing and the second bearing and forming a seal between the drive shaft and the bore of the housing;

a first fluid chamber defined at least in part by the tapered bearing and the housing;

a second fluid chamber located on the opposite side of the tapered bearing from the first fluid chamber, the second fluid chamber being defined by the tapered bearing, the housing, the drive shaft and the first seal;

wherein the housing includes a fluid passage fluidly coupling the first fluid chamber and the second fluid chamber.

13. The engine of claim 12, further comprising a second seal located between the first seal and the second bearing, the second seal forming a seal between the drive shaft and the bore of the housing.

14. The engine of claim 12, wherein the fuel transfer pump further includes a driven member located within the second fluid chamber, and wherein the driven member is coupled to a first end of the drive shaft.

15. The engine of claim 14, wherein the fuel transfer pump further includes a working member and a third fluid chamber located on the opposite side of the first seal from the second fluid chamber, the working member being received within the third fluid chamber and being coupled to a second end of the drive shaft opposite the first end.

16. The engine of claim 15, wherein the fuel transfer pump further includes a first fluid in the second fluid chamber and a second fluid in the third fluid chamber, the first fluid being a different fluid than the second fluid.

17. The engine of claim 12, wherein the fluid passage in the housing is a groove that extends from a first side of the tapered bearing to a second side of the tapered bearing opposite the first side.

* * * * *